US005453350A

United States Patent [19]

Kurachi et al.

[11] Patent Number: 5,453,350

[45] Date of Patent: Sep. 26, 1995

[54] ANTISTATIC LIGHT-SENSITIVE SILVER HALIDE PHOTOGRAPHIC MATERIAL

[75] Inventors: Yasuo Kurachi; Hidetoshi Ezure; Yoshihiro Wada; Akihisa Nakajima, all of Hino, Japan

[73] Assignee: Konica Corporation, Tokyo, Japan

[21] Appl. No.: 269,198

[22] Filed: Jun. 30, 1994

[30] Foreign Application Priority Data

Jul. 6, 1993 [JP] Japan ..... 5-167051

[51] Int. Cl.[6] ..... G03C 1/85

[52] U.S. Cl. ..... 430/527; 430/523; 430/531; 430/533; 430/966

[58] Field of Search ..... 430/527, 523, 430/531, 533, 966

[56] References Cited

U.S. PATENT DOCUMENTS 5,122,445 6/1992 Ishigaki ..... 430/523

5,326,689 7/1994 Murayama ..... 430/527

*Primary Examiner*—Charles L. Bowers, Jr.

*Assistant Examiner*—Geraldine Letscher

*Attorney, Agent, or Firm*—Frishauf, Holtz, Goodman, Langer & Chick

[57] ABSTRACT

A silver halide photographic light-sensitive material is disclosed. The light-sensitive material comprises a support having a dielectric constant for 100 Hz of not larger than 2.80 having thereon, a silver halide emulsion layer and a particle-containing layer comprising non-light-sensitive fine particles having a volume resistivity of from $10^{-2}$ Ω.cm to $10^{8}$ Ω.cm.

10 Claims, No Drawings

ANTISTATIC LIGHT-SENSITIVE SILVER HALIDE PHOTOGRAPHIC MATERIAL

FIELD OF THE INVENTION

The present invention relates to a light-sensitive silver halide photographic material improved in its antistatic properties. More particularly, it relates to an X-ray light-sensitive silver halide photographic material kept from formation of static marks.

BACKGROUND OF THE INVENTION

Light-sensitive silver halide photographic materials can form images with a high sensitivity and a high resolution, and hence they are put in wide use. As an example of their use, they are used in the field of X-ray photography. Images of tissues and skeletons of patients can be obtained by irradiating the related part of a patient with X-rays, and exposing to the rays having transmitted therethrough a photographic element comprising a blue-colored transparent film support provided thereon with at least one light-sensitive silver halide photographic emulsion layer.

Meanwhile, plastic films so strongly tend to be statically charged that their use is greatly restricted in many instances. For example, in the case of X-ray light-sensitive silver halide photographic materials, supports made of polyethylene terephthalate are commonly used, which tend to be statically charged in an environment of low humidity as in the winter to cause many difficulties. In particular, the most important difficulties are static marks which may form as a result of release of charges stored before photographic processing. This results in an entire loss of commercial values of photographic films. In particular, in the case of X-ray light-sensitive silver halide photographic materials for medical use or industrial use, the worst may result such that a very dangerously wrong judgement is made. Thus, when X-ray light-sensitive silver halide photographic materials are designed, it is the most important subject to keep static marks from occurring.

Formation of static marks causes a serious damage on images also in the case of light-sensitive materials other than the X-ray light-sensitive silver halide photographic materials, for example, monochromatic light-sensitive photographic materials such as light-sensitive materials for graphic arts, and light-sensitive materials for color photography, and it is sought for them to be kept from occurrence of static marks.

The best way to keep static marks from forming is to raise conductivity of substances so that static charges can be escaped in a short time before the charges accumulated are released. Accordingly, methods for raising conductivity of supports or various types of surface layers of light-sensitive photographic materials have been hitherto proposed, and it has been attempted to use various types of moisture-absorptive substances and water-soluble inorganic salts, certain kinds of surface active agents, polymers, and so forth. Many of these substances exhibit specificities depending on the types of film supports and the differences in photographic composition and can produce good results on certain types of film supports and photographic emulsions or other photographic components. However, they not only can be of no use to antistatic on different types of film supports and photographic components, but also may adversely affect photographic performances. As additional important disadvantages of many of these substances, their conductivity has a moisture dependence, resulting in a loss of functions as conductive layers in an environment of low humidity.

For the purpose of better preventing such deterioration of performances in an environment of low humidity, Japanese Patent Examined Publications No. 6616/1960 and No. 143431/1981 disclose techniques in which metal oxides are used as agents for antistatic treatment. The former discloses a method in which a colloidal sol dispersion is used. The latter discloses a method in which a powder with a high crystallinity is used after it has been treated at a high temperature so that the problem of an insufficient conductivity in the former can be overcome. When, however, the latter technique is used as a measure for light-sensitive photographic materials, there is a problem of light scattering because of the use of the powder with a high crystallinity, where its particle diameter, particle/binder ratios and so forth must be taken into account.

Japanese Patent Publication Open to Public Inspection (hereinafter referred to as Japanese Patent O.P.I. Publication) No. 62650/1983 discloses a technique in which a crystalline metal oxide is used as an antistatic agent, but there is no disclosure as to its relationship with static marks.

SUMMARY OF THE INVENTION

An object of the present invention is to provide a light-sensitive silver halide photographic material comprising a specific plastic film used as a photographic support, and kept from attraction of dust and occurrence of static marks, having a good antistatic performance, without adversely affecting photographic performances.

A silver halide photographic light-sensitive material of the invention comprises a support having a dielectric constant for 100 Hz of not larger than 2.80, having thereon a silver halide emulsion layer and a particle-containing layer comprising non-light-sensitive fine particles having a volume resistivity of from $10^{-2}$ Ω.cm to $10^{8}$ Ω.cm, hereinafter referred to "fine particles of the invention. It is preferable that the volume fraction of the fine particle in the file particles-containing layer is within the range of from 5% to 50%.

DETAILED DESCRIPTION OF THE INVENTION

In the present invention, the layer that constitutes a light-sensitive silver halide photographic material includes a subbing layer or layers provided on one side or both sides of a support in order to assure firm adhesion between the support and a photographic emulsion layer or layers, and also includes light-sensitive photographic emulsion layers, intermediate layers, protective layers, backing layers, antihalation layers, filter layers, and antistatic layers.

The dielectric constant of the support that stands in combination with the layer containing the fine particles of the present invention can be measured by means of a commonly available impedance measuring device used in the measurement of dielectric constant of electronic parts, and preferably an equipment comprised of a combination of an impedance measuring device that enables measurement at a frequency of 10 Hz or below and a film measuring electrode, for example, a combination of a precision LCR meter HP4284A and a dielectric measuring electrode HP16451B, available from YHP Corp. When other equipment is used, correction must be made at the electrode portion. In order to accomplish the present invention, the dielectric constant of a support must be accurately measured, and hence no preferable results can be obtained when any equipment allowing no correction is used. The present inventors examined the relationship between the dielectric constant of photographic supports and the formation of static marks in light-sensitive silver halide photographic materials provided with a layer containing fine conductor or semiconductor particles. As a result, they have discovered that the static marks can be very well kept from occurring when the support has a dielectric constant of 2.80 or less at a frequency of 100 Hz. The dielectric constant at a frequency of 100 Hz should preferably be from 2.00 to 2.80, and more preferably from 2.20 to 2.60.

The support that can be used in the present invention may be made of a material including, for example, fluorine resins such as polytetrafluoroethylene and a tetrafluoroethylene/hexafluoropropylene copolymer, polyphenylene oxide, modified polyphenylene oxide, polyethylene, polypropylene, polystyrene, polybutene-1, and polyesters such as polyethylene-2,6-naphthalate. Of these, polyethylene film, polystyrene film and polyester film are preferred as the support in view of optical properties such as transparency and haze. Polyester film is particularly preferred in view of strength. Polyethylene-2,6-naphthalate film is more preferred. A preferable thickness of the polyethylene-2,6-naphthalate support is 1 μm to 1000 μm, more preferably 10 μm to 500 μm, further preferably 10 μm to 200 μm.

The polyethylene-2,6-naphthalate that is most preferred as a material for the photographic support in the present invention refers to a polymer substantially composed of ethylene-2,6-naphthalate units as component units. It may also include ethylene-2,6-naphthalate polymers modified by a third component added in a small amount of, for example, not more than 20 mol %, preferably not more than 10 mol %, and more preferably not more than 5 mol %.

The polyethylene-2,6-naphthalate is commonly produced by subjecting naphthalene-2,6-dicarboxylic acid, or its functional derivative as exemplified by methyl naphthalene-2,6-dicarboxylate, and ethylene glycol to condensation in the presence of a catalyst under appropriate reaction conditions. In such an instance, the third component that can be used may include, for example, dicarboxylic acids such as adipic acid, oxalic acid, isophthalic acid, terephthalic acid, naphthalene-2,7-dicarboxylic acid and diphenyl ether dicarboxylic acid or lower alkyl esters thereof, monocarboxylic acids such as p-hydroxybenzoic acid and p-ethoxybenzoic acid or lower alkyl esters thereof, dihydric alcohols such as propylene glycol, trimethylene glycol, tetramethylene glycol, pentamethylene glycol, hexamethylene glycol and diethylene glycol, and polyalkylene glycols such as polyethylene glycol and polytetramethylene glycol.

When these are polymerized, a lubricant such as titanium dioxide, a stabilizer such as phosphoric acid or phosphorous acid and ester salts of these, an antioxidant such as hindered phenol, a polymerization regulator, a plasticizer and so forth may also be added.

The polyethylene-2,6-naphthalate used in the present invention may preferably have a limiting viscosity of 0.4 or more, and more preferably from 0.55 to 0.9. With regard to its degree of crystallization, and a degree of crystallization of not less than 35% to not more than 60% is preferred taking account of dimensional stability.

The crystallization degree is determined the following equation.

$$\chi_c=\{(\rho-\rho_a)/(\rho_{c-\rho c})\}\times 100\%$$

In the above, $\rho$, $\rho_a$ and $\rho_c$ are each a density of a sample, that of the sample in an amorphous form and a perfectly crystallized form, respectively. The density of the sample is determined by a density-gradient tube method using a density gradient-tube with n-heptane/tetrachloromethane system.

In use of the polyethylene-2,6-naphthalate film of the present invention, its commercial value may decrease if it has attracted dust when used. As countermeasures therefor, appropriate methods are employed, e.g., a method in which the film is coated with an antistatic agent, a method in which an antistatic agent is added when polyester materials are polymerized, and a method in which polyester materials and an antistatic agent are mixed when the film is formed. In these methods, polyethylene-2,6-naphthalene obtained by polycondensation in the presence of a sodium alkylbenzene sulfonate and a polyalkylene glycol used as materials may be used.

The polyethylene-2,6-naphthalene used in the present invention refers to those held by not less than 40 mol %, preferably not less than 60 mol %, and more preferably not less than 80 mol %, of dimethyl naphthalene-2,6-dicarboxylate in acid monomer components to be polymerized.

The support film may preferably be stretched. There are no particular limitations on the conditions for stretching. The film may preferably be longitudinally stretched by 3.3±0.3 times at a point of 30° C.±25° C. around the glass transition point of an unstretched film and subsequently laterally stretched by 3.6±0.6 times under the same temperature conditions. After the stretching, the film may preferably be further heated at 250°±8° C. This heating may more preferably be applied not in one stage only and in two stages.

The fine particles of the present invention may be any of those having a volume resistivity determined at a room temperature of from $10^8$ Ω.cm to $10^{-2}$ Ω.cm, preferably $10^8$ to $10^0$ Ω.cm, more preferably $10^8$ to $10^2$ Ω.cm, and may be comprised of an organic material or an inorganic material, or a composite material of the both, having a conductivity attributable to charge carriers as exemplified by cations, anions, electrons and positive holes present in the particles. They may preferably be comprised of a compound having an electronic conductivity, which may include, as organic materials, fine particles of polymers such as polyaniline, polypyrrole and polyacetylene, and, as inorganic materials, fine particles of metal oxides readily capable of forming nonstoichiometric compounds such as oxygen-deficient compounds, metal-excess compounds, metal-deficient compounds and oxygen-excess compounds. As electron transfer complexes or organic-inorganic composite materials, it may also include phosphazene metal complexes. Of these, compounds most preferable for the present invention are fine metal oxide particles the manner of production of which can be in variety.

With regard to the fine metal oxide particles, those having a higher crystallinity have a higher conductivity, but may cause problems on workability such that their particle diameter, particle/binder ratios and so forth must be taken into account as a countermeasure for light scattering, that they may cause fog in silver halide emulsions and also that they can be uniformly dispersed with difficulty. Hence, fine metal oxide particles with a low crystallinity are preferred.

When crystallite size is used as a measure of the crystallinity, it may preferably be not smaller than 5 Å, to not larger than 1,000 Å, more preferably not smaller than 5 Å, to not larger than 500 Å, and most preferably not smaller than 5 Å to not larger than 300 Å. The crystallite size can be measured according to the following Scherer's formula on the basis of measurements obtained by powder X-ray diffraction.

$$t=(.9*\lambda)/(B*\cos\theta_B)$$

wherein;

B is a half width of a diffraction curve based on the reflection on a certain plane of a crystal, measured by powder X-ray diffraction, and is measured in radian;

$\lambda$ is a wavelength of X-rays; and $\theta_B$ is a Bragg angle.

Such fine metal oxide particles may preferably be exemplified by ZnO, $TiO_2$, $SnO_2$, $Al_2O_3$, $In_2O_3$, $SiO_2$, MgO, BaO and MoO, particularly preferably ZnO, $TiO_2$ and $SnO_2$, and still particularly preferably $SnO_2$. Those doped with different kind of atoms can be exemplified by ZnO doped with Al, In or the like, $TiO_2$ doped with Nb, Ta or the like, and $SnO_2$ doped with Nb, Sb, a halogen or the like.

Fine particles having a low crystallinity and a high conductivity may include metal oxide colloids. In particular, colloidal $SnO_2$ sols comprised of stannic oxide can be produced by any methods including a method in which they are produced by dispersing ultrafine $SnO_2$ particles in a suitable solvent, and a method in which they are produced by subjecting a solvent-soluble Sn compound to decomposition reaction in a solvent. In particular, a stannic oxide sol produced by the method disclosed in Japanese Patent Examined Publication No. 6616/1960 is preferred.

The average size of the fine particles is preferably not larger than 10 μm, more preferably 0.0001 μm to 5 μm, further preferably 0.001 μm to 1 μm.

The fine particles of the present invention may be applied by the aid of a coating solution containing no binder. In such an instance, the fine particles thus applied may preferably be further coated with a binder.

The fine particles of the present invention may more preferably be coated together with a binder. There are no particular limitations on the binder. Water-soluble binders may be used, as exemplified by proteins such as gelatin and colloidal albumin; cellulose compounds such as carboxymethyl cellulose, hydroxyethyl cellulose, diacetyl cellulose and triacetyl cellulose; polyvinyl alcohol, poly-N-vinyl pyrrolidone, polyacrylic acid copolymers, polyacrylamide, or derivatives and partially hydrolyzed products of these. Synthetic polymeric binders such as polyvinyl acetate, polyacrylate, a styrene/butadiene copolymer, polyacrylic acid, polyacrylate, polyurethane, polyvinylidene chloride, polystyrene, polyester, polyethylene, polycarbonate, polyethylene oxide and polypropylene may also be used by dissolving them in organic solvents. These polymeric binders may also be used in the form of aqueous dispersions.

Polymer latexes may still also be used, as exemplified by those of vinyl acetate, alkyl allylates, n-butyl acrylate, ethylene acrylate, styrene, butadiene, vinyl acetate, acrylonitrile and sulfoacrylonitrile.

There are no particular limitations on the layer to which the fine particles of the present invention are added. The layer can be exemplified by anti-halation layers, subbing layers, intermediate layers between an subbing layer and a silver halide emulsion layer, intermediate layers between silver halide emulsion layers, surface-protective layers, backing layers, backing-protective layers, emulsion layers, and UV layers. Of these, anti-halation layers, subbing layers, intermediate layers between an undercoat layer and a silver halide emulsion layer, intermediate layers between silver halide emulsion layers, surface-protective layers, backing layers and backing-protective layers are preferred, and subbing layers, intermediate layers between an subbing layer and a silver halide emulsion layer, intermediate layers between silver halide emulsion layers, surface-protective layers and backing layers are particularly preferred.

In the layer containing the fine particles of the present invention, the fine particles preferably may be in a volume fraction of from 5 to 50%, more preferably 5 to 30%.

The volume fraction of the fine particles in the layer is determined as a ratio of the volume of the fine particles to the volume of the layer containing the particles. The volume of the fine grain particles is calculated from the weight of the particles and the density of a crystal of the substance of the particles. The volume of the layer can be calculated from the thickness of the layer.

The thickness of the layer containing the fine particles of the present invention may vary depending on what layer is incorporated with such fine particles. It may preferably be in the range of from 0.05 to 5.0 μm, and particularly preferably from 0.1 to 3.0 μm.

The light-sensitive material according to the present invention may include various light-sensitive materials, i.e., usual black-and-white light-sensitive silver halide photographic materials as exemplified by photographing black-and-white light-sensitive materials, X-ray black-and-white light-sensitive materials and graphic arts black-and-white light-sensitive materials, and usual multi-layer color light-sensitive materials as exemplified by color reversal films, color negative films and color positive films. In particular, the present invention can be greatly effective for high-temperature rapid-processing light-sensitive silver halide photographic materials and high-speed light-sensitive silver halide photographic materials.

A photographic binder may include proteins such as gelatin, colloidal albumin and casein; cellulose compounds such as carboxymethyl cellulose, hydroxyethyl cellulose, diacetyl cellulose and triacetyl cellulose; sugar derivatives such as agar-agar, sodium alginate and starch derivatives; and synthetic hydrophilic colloids as exemplified by polyvinyl alcohol, poly-N-pyrrolidone, polyacrylic acid copolymers, polyacrylamide, or derivatives and partially hydrolyzed products of these; any of which may be used in combination. The gelatin herein mentioned refers to what is called rime-processed gelatin, acid-processed gelatin or enzym-processed gelatin.

There are no particular limitations on silver halides used in the silver halide emulsion layers, surface-protective layers and so forth of the light-sensitive photographic material of the present invention, the process for producing them, the manner by which they are chemically sensitized, antifoggants, stabilizers, hardening agents, antistatic agents, plasticizers, lubricants, coating auxiliaries, matting agents, brighteners, spectral sensitizers, dyes, color couplers and so forth. For example, their reference can be made to Product Licensing, Vol. 92, pages 107–110 (December, 1971), and Research Disclosure, Vol. 176, pages 22–31 (December, 1978).

To the photographic component layers of the present invention, known surfactants may be added alone or in combination. Usable surfactants may include natural surfactants such as saponin, nonionic surfactants such as alkylene oxides, glycerols and glycidols, cationic surfactants such as higher alkyl amines, quaternary ammonium salts, pyridine and other heterocyclics, and phosphonium or sulfonium, anionic surface active agents containing acidic groups such as carboxylic acid, sulfonic acid, phosphoric acid, sulfates and phosphates, and amphoteric surfactants such as amino acids, aminosulfonic acids and sulfates or phosphates of amino alcohols.

The light-sensitive photographic material of the present invention may contain in its photographic component layers the polymer latex as disclosed in U.S. Pat. No. 3,411,911.

EXAMPLES

Example 1

Preparation of fine-particle disperson A-1 of the invention:

In 2,000 ml of a water/ethanol mixture solution, 65 g of stannic chloride hydrate was dissolved to obtain a uniform solution. The solution obtained was boiled to obtain a coprecipitate. The coprecipitate thus formed was taken out by decantation, and the precipitate was washed with distilled water many times. In the distilled water with which the precipitate was washed, silver nitrate was dropwise added to make sure that no reaction of chloride ions took place, and thereafter 1,000 ml of distilled water was added to make up the solution to 2,000 ml in total. To the solution, 40 ml of 30% ammonia water was further added, followed by heating in a water bath to obtain a colloidal gel dispersion. This colloidal gel dispersion was designated as dispersion A-1. Electron-microscopic observation of colloid particles revealed that they had an average primary particle diameter of 30 nm and a crystallite size of 20 nm. The volume resistivity of the particle was $10^5$ Ω.cm.

Preparation of fine-particle disperson A-2 of the invention:

In 2,000 ml of a water/ethanol mixture solution, 65 g of stannic chloride hydrate and 1.0 g of antimony trichloride were dissolved to obtain a uniform solution. The solution obtained was boiled to obtain a coprecipitate. The coprecipitate thus formed was taken out by decantation, and the precipitate was washed with distilled water many times. In the distilled water with which the precipitate was washed, silver nitrate was dropwise added to make sure that no reaction of chloride ions took place, and thereafter 1,000 ml of distilled water was added to make up the solution to 2,000 ml in total. To the solution, 40 ml of 30% ammonia water was further added, followed by heating in a water bath to obtain a colloidal gel dispersion. This colloidal gel dispersion was designated as dispersion A-2. The particle size of the dispersion measured in the same manner as in A-1 was 25 nm, the crystalite size was 20 nm and the volume resistivity was $10^4$ Ω.cm.

Preparation of fine-particle powder A-3 of the invention:

In 1,000 ml of ethanol, 65 g of stannic chloride hydrate and 1.5 g of antimony trichloride were dissolved to obtain a uniform solution. To the solution obtained, an aqueous 1N sodium hydroxide solution was dropwise added until the solution came to have a pH of 3, to obtain a coprecipitate of colloidal stannic oxide and antimony oxide. The coprecipitate thus formed were left to stand for 24 hours at 50° C., so that a reddish-brown colloidal precipitate was obtained. The particle size of the colloidal precipitation was 25 nm, the crystalite size was 22 nm, and the volume resistivity was $5\times10^3$ Ω.cm.

The reddish-brown colloidal precipitate was separated by centrifugation. In order to remove excess ions, water was added to the precipitate, followed by washing with water by centrifugation. This procedure was repeated three times to remove the excess ions.

Into 50 g of barium sulfate with an average particle diameter of 0.3 μm and 1,000 g of water, 100 g of the colloidal precipitate from which the excess ions had been removed was mixed, and the mixture was sprayed into a furnace heated to 900° C. Thus, a powdery mixture A-3 was obtained, which was comprised of stannic oxide and barium sulfate, having a bluish color and an average particle diameter of 0.1 μm.

Preparation of fine-particle disperson A-4 of the invention:

To 20 g of barium titanyl oxalate $BaTiO(C_2O_4)_2 4H_2O$, 0.02 g of $SbO_2$ was added, followed by heating at 850° C. for 5 hours. The resulting powder was pulverized for 24 hours in a ball mill with balls made of zirconia to obtain a conductive perovskite compound powder with an average particle diameter of 0.5 μm. A portion of this powder was put in a thin-wall rubber mold made from latex, and then compression-molded at a hydrostatic pressure of 2,000 kg/cm$^2$. Thereafter, the conductivity of the molded product was measured to reveal that it was $10^5$ Ω.cm. The powder was also dispersed in water in a concentration of 30% to form a dispersion, followed by further pulverization for 48 hours in a ball mill with balls made of zirconia, so that a dispersion of fine particles with an average particle diameter of 0.1 μm was obtained. This dispersion was designated as A-4.

Preparation of support:

(Synthesis of PEN)

To 100 parts by weight of dimethyl 2,6-naphthalenedicarboxylate and 56 parts by weight of ethylene glycol, 0.1 part by weight of a hydrate of calcium acetate was added as an ester exchange catalyst to carry out esterification by a conventional method. Thereafter, to the product obtained, 0.04 part by weight of antimony trioxide and 0.1 part by weight of trimethyl phosphate were added. Subsequently, the temperature and pressure were gradually raised and reduced, respectively, to carry out polymerization at 285° C. and 0.5 mmHg. Thus, polyethylene-2,6-naphthalate (PEN) was obtained.

(Production of PEN film)

The PEN thus obtained was melt-extruded through a T-die in the shape of a film, which was then rapidly cooled to solidify on a cooling drum to obtain an unstretched film. At this time, the take-off speed of the cooling drum was controlled in two stages, where a 1,054 μm thick unstretched film was pre-heated at 135° C. and longitudinally stretched by 3.1 times, then laterally stretched by 3.4 times at 130° C., and was further heat-set at 250° C. Thus, a 130 μm thick biaxially stretched film PEN-1 was obtained.

The same procedure was repeated using a 527 μm thick unstretched film, to produce a 50 μm thick biaxially stretched film PEN-2.

(Polyethylene, polystyrene)

Commercially available 100 μm thick polyethylene (PE) and polystyrene (PS) films were used as supports as they were.

Dielectric constant of each of the above films was measured in the following way.

Measurement of dielectric constant:

Using a precision LCR meter HP4284A and a dielectric measuring electrode HP16451B, available from Yokogawa Hulett Packard Corp., and also a homemade shield, the dielectric constant at 100 Hz was measured by the electrode non-contact method in an environment of 23° C. and 20% RH and at a gap distance of 10 μm.

Preparation of light-sensitive photographic material:

Corona discharging of 8 W/m$^2$.min was applied to the above 4 kinds of photographic supports, i.e., PEN-1, PEN-2, PE and PS, on their both sides. On one side of each support thus treated, subbing coating solution B-1 composed as shown below was coated so as to be in a dried coating thickness of 0.8 μm to form subbing layer B-1, followed by drying at 100° C. for 1 minute. On the side opposite to the subbing layer B-1 of the support, subbing coating solution B-2 composed as shown below was coated so as to be in a dried coating thickness of 0.8 μm to form subbing layer B-2, followed by drying at 100° C. for 1 minute.

*subbing first layer

Subbing coating solution B-1

| | |
|---|---|
| Copolymer latex solution comprised of 30% by weight of butyl acrylate, 20% by weight of t-butyl acrylate, 25% by weight of styrene and 25% by weight of 2-hydroxyethyl acrylate (solid content: 30%) | 270 g |
| Compound C-1 | 0.6 g |
| Hexamethylene-1,6-bis(ethyleneurea) | 0.8 g |
| Made up to 1 liter by adding water. | |

Subbing coating solution B-2

| | |
|---|---|
| Copolymer latex solution comprised of 40% by weight of butyl acrylate, 20% by weight of styrene and 40% by weight of glycidyl acrylate (solid content: 30%) | 270 g |
| Compound C-1 | 0.6 g |
| Hexamethylene-1,6-bis(ethyleneurea) | 0.8 g |
| Made up to 1 liter by adding water. | |

* Subbing second layer

Corona discharging of 8 W/m$^2$.min was further applied to each support on its subbing layer B-1 and subbing layer B-2, and subbing coating solution B-3 and subbing coating solution B-4 each composed as shown below were coated on the side of B-1 and on the side of B-2, respectively, so as to be in a dried coating thickness of 0.8 μm on each side, followed by drying at 100° C. for 1 minute. Subbing coating solution B-4 used was prepared using the aforesaid A-1, A-2, A-3 or A-4 as the fine particles of the present invention. Thus, support samples No. 1 to No. 11 as shown in Table 1 were obtained.

Comparative samples No. 12 to No. 15 were also prepared in the same manner except that subbing coating solution B-4 was replaced with subbing coating solution B-3 to form the subbing second layer (sample No. 12), and the support made of polyethylene naphthalate was replaced with a support made of polyethylene terephthalate (sample No. 13), a support made of polyethylene (sample No. 14) or a support made of polystyrene (sample No. 15).

Subbing coating solution B-3

| | |
|---|---|
| Latex solution comprised of a butyl acrylate/styrene/glycidyl acrylate copolymer (40:20:40 wt. %) (solid content: 20%) | 80 g |
| Ammonium sulfate | 0.5 g |
| Hardening agent, N,N'-hexamethylene-bis(1-aziridine-carboxide) | 12 g |
| Polyethylene glycol | 6 g |
| Made up to 1 liter by adding water. | |

Subbing coating solution B-4

| | |
|---|---|
| Latex solution comprised of a butyl acrylate/styrene/glycidyl acrylate copolymer (40:20:40 wt. %) (solid content: 20%) | 80 g |
| Ammonium sulfate | 0.5 g |
| Hardening agent, N,N'-hexamethylene-bis'1-aziridine-carboxide) | 12 g |
| Polyethylene glycol | 6 g |
| Dispersion A-1, A-2 or A-4, or powder A-3 | as shown in Table 1 |

Made up to 1 liter by adding water.

Compound C-1

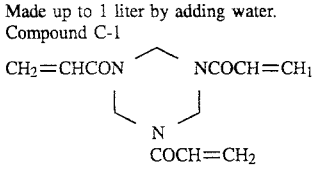

-continued

Compound C-2

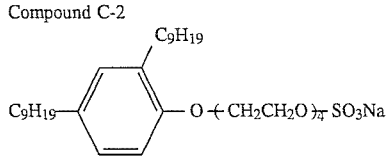

On the fifteen kinds of film supports having the subbing layers formed in manner as described above, a silver halide emulsion coating solution and an emulsion layer protective coating solution were coated so as to make gelatin coating weight of the emulsion layer to be 2.0 g/m$^2$ and that of the protective layer to be 1.5 g/m$^2$. Also, on the side opposite to the emulsion layer, a backing layer coating solution and a backing layer protective coating solution were coated, in which coating weight of gelatin of the backing layer and the backing protective layer of were 2.0 g/m$^2$ and 1.0 g/m$^2$, respectively. These coating solutions were prepared in the manner as described below and were simultaneously coated layer by layer, followed by drying to form corresponding four layers. Thus, samples No. 1 to No. 15 were produced.

Preparation of silver halide emulsion coating solution:

(Preparation of emulsion)

A silver chlorobromide emulsion was prepared in the following manner.

23.9 mg of sodium pentabromorhodate per 60 g of silver nitrate, an aqueous solution containing sodium chloride and potassium bromide and an aqueous solution of silver nitrate were mixed in an aqueous gelatin solution with stirring to carry out double-jet precipitation at 40° C. for 25 minutes. Thus, silver chlorobromide emulsions each having an average grain size of 0.20 μm were obtained.

To these emulsions, 200 mg of 6-methyl-4-hydroxy-1,3,3a,7-tetrazaindene was added as a stabilizer, followed by washing with water to effect desalting.

To each emulsion, 20 mg of 6-methyl-4-hydroxy-1,3,3a,7-tetrazaindene was added, followed by sulfur sensitization. After the sulfur sensitization was completed, gelatin was added, and then 6-methyl-4-hydroxy-1,3,3a,7-tetrazaindene was added as a stabilizer. Subsequently, water was added so as to be made up to 260 ml. Emulsions were thus prepared.

(Preparation of emulsion additive latex)

To a solution obtained by adding 0.25 kg of KMDS (dextran sodium sulfate, available from Meito Sangyo Co., Ltd.) and 0.05 kg of ammonium persulfate to 40 liter of water, a solution of a mixture of 4.51 kg of n-butyl acrylate, 5.49 kg of styrene and 0.1 kg of acrylic acid was added over a period of 1 hour in an atmosphere of nitrogen with stirring at a liquid temperature of 81° C. Thereafter, 0.005 kg of ammonium persulfate was added, further followed by stirring for 1.5 hours and then cooling. Thereafter, the pH was adjusted to 6 using ammonia water.

The latex solution obtained was filtered with GF/D filter, available from Whatmann Co., and made up to 50.5 kg by adding water. Thus, a monodisperse latex with an average particle diameter of 0.25 μm was produced.

(Preparation of emulsion coating solution)

To the above emulsion, 9 mg of compound D-1, a mixture of components A, B and C, was added, and thereafter the pH was adjusted to 6.5 using a 0.5N sodium hydroxide solution. Subsequently, 360 mg of compound D-2 shown below was added, and also, per mol of silver halide, 5 ml of an aqueous 20% saponin solution, 180 mg of sodium dodecylbenzenesulfonate, 80 mg of 5-methylbenztriazole and 43 ml of the above emulsion additive latex solution were further added. Then, 60 mg of compound D-3 shown below and as a thickening agent 280 mg of a water-soluble polymer comprising a styrene/maleic acid copolymer were successively added, and the solution was made up to 475 ml by adding water. Thus, an emulsion coating solution was prepared.

Preparation of emulsion layer protective coating solution:

Pure water was added to 50 g of gelatin. After swelled, the gelatin was dissolved at 40° C. Subsequently, as a coating auxiliary an aqueous 1% solution of compound D-4 shown below and, as filter dyes, 30 mg of D-5 and 30 mg of D-6 shown below were successively added. Then the pH was adjusted to 6.0 using an aqueous citric acid solution. A matting agent, amorphous silica with a particle diameter of 4.0 μm, was also added. Thus, an emulsion layer protective coating solution was prepared.

Compound D-1

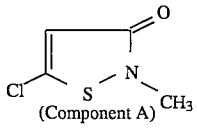

(Component A)

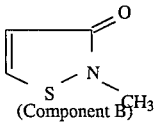

(Component B)

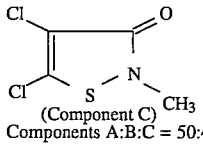

(Component C)

Components A:B:C = 50:46:4 (molar ratio)

Compound D-2

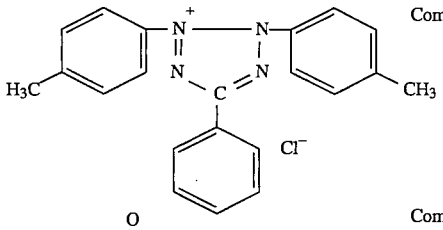

Compound D-4

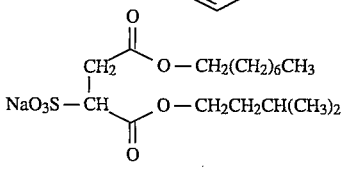

Compound D-3

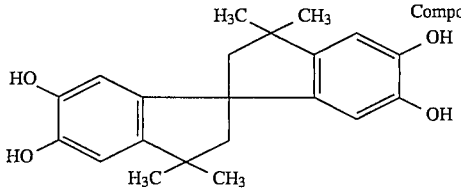

-continued

Compound D-5

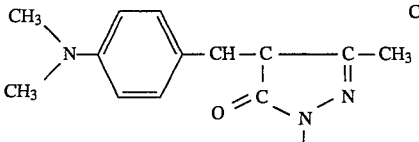

Compound D-6

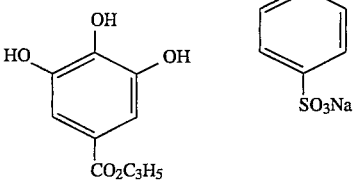

Preparation of backing layer coating solution: 36 g of gelatin was swelled in water, and then dissolved while heating. Thereafter, 1.6 g, 310 mg and 1.9 g of the following compounds D-7, D-8 and D-9, respectively, and 2.9 g of the above compound D-5 were added in the form of an aqueous solution. Next, 11 ml of an aqueous 20% solution of saponin and as a physical property regulator 5 g of compound D-10 shown below were also added, and as a methanol solution 63 mg of compound D-11 shown below was further added. To the resulting solution, as a thickening agent 800 mg of a water-soluble polymer comprising a styrene/maleic acid copolymer was added to control its viscosity. Then the pH was adjusted to 5.4 using an aqueous citric acid solution, and 1.5 g of a reaction product of polyglycerol with epichlorohydrin was also added, followed by further addition of 144 mg of glyoxal. The solution was made up to 960 ml by adding water. Thus, a backing layer coating solution was prepared.

Compound D-7

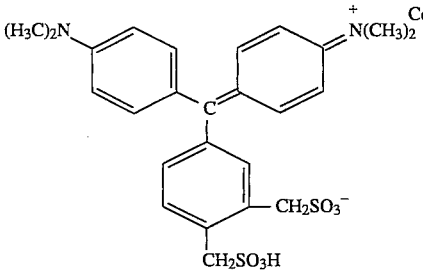

Compound D-8

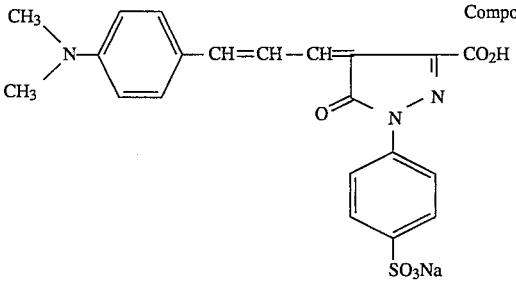

-continued

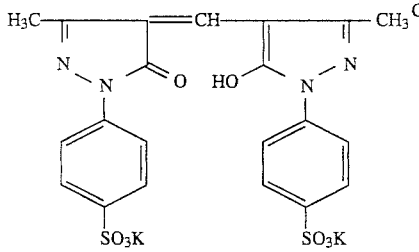

Compound D-9

Copolymer latex of $\left(CH_2-CH\right)_m$ $\left(CH_2-C\right)_n$ (with $CO_2C_9H_9$ and Cl) where m:n = 1:1

Compound D-10

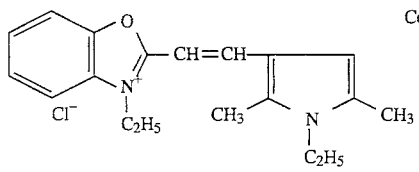

Compound D-11

Preparation of backing layer protective coating solution:

50 g of gelatin was swelled in water, and then dissolved while heating. Thereafter, 340 mg of 2-sulfonate sodium bis(2-ethylhexyl)succinate and 100 mg of compound D-12 shown below were added. Then, 1.7 g of polymethyl methacrylate particles with average particle diameter of about 0.4 μm and 3.4 g of sodium chloride were added, and 1.1 g of glyoxal and 540 mg of mucochloric acid were further added. The solution was made up to 1,000 ml by adding water. Thus, a backing layer protective coating solution was prepared.

$NaO_3-CH(CH_2-COOCH_2(CF_2)_6H)-COOCH_2(CF_2)_6H$ Compound D-12

Formation of static marks of the respective samples No. 1 to No. 15 thus obtained were measured in the following way: Unexposed samples were moisture-conditioned in an environment of 25° C. and 25% RH for 24 hours, and thereafter put on a metal plate (a stainless steel plate) or a rubber sheet with the surfaces of emulsion layers face-to-face. These were pressed down together by means of a rubber roller, and then separated. Formation of static marks caused by the separation were evaluated after the samples were developed, fixed and washed with water under conditions shown below.

Results of evaluation are indicated according to a criterion grouped into four ranks.

Evaluation of formation of static marks:

A: Static marks are seen to have not formed at all.

B: Static marks are seen to have formed a little.

C: Static marks are seen to have formed rather greatly.

D: Static marks are seen to have formed on substantially the whole surface.

| Formulation of Developer | |
|---|---|
| (Composition A) | |
| Pure water (ion-exchanged water) | 150 ml |

-continued

| Formulation of Developer | |
|---|---|
| Disodium ethylenediaminetetraacetate | 2 g |
| Diethylene glycol | 50 g |
| Potassium sulfite (aqueous 55% w/v solution) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide; in an amount necessary to adjust the pH of the service solution to 10.9 | |
| Potassium bromide | 4.5 g |
| (Composition B) | |
| Pure water (ion-exchanged water) | 3 ml |
| Diethylene glycol | 50 g |
| Disodium ethylenediaminetetraacetate | 25 mg |
| Acetic acid (aqueous 90% solution) | 0.3 ml |
| 5-Nitroindazole | 110 ml |
| 1-Phenyl-3-pyrazolidone | 500 mg |

When the developer was used, the above compositions were dissolved in 500 ml of water in the order of Composition A and Composition B so as to be made up to 1 liter.

| Formulation of Fixer | |
|---|---|
| (Composition A) | |
| Ammonium thiosulfate (aqueous 72.5% w/v solution) | 230 ml |
| Sodium sulfite | 9.5 g |
| Sodium acetate trihydrate | 15.9 g |
| Boric acid | 6.7 g |
| Sodium citrate dihydrate | 2 g |
| Acetic acid (aqueous 90% w/w solution) | 8.1 ml |
| (Composition B) | |
| Pure water (ion-exchanged water) | 17 ml |
| Sulfuric acid (aqueous 50% w/w solution) | 5.8 g |
| Aluminum sulfate (aqueous solution with a content of 8.1% w/w in terms of $Al_2O_3$) | 26.5 g |

When the fixing solution was used, the above compositions were dissolved in 500 ml of water in the order of Composition A and Composition B so as to be made up to 1 liter. The pH of the resulting fixing solution was about 4.3.

| Conditions for rapid photoaraphic processing | | |
|---|---|---|
| (Steps) | (Temperature) | (Time) |
| Developing | 34° C. | 15 sec. |
| Fixing | 34° C. | 15 sec. |
| Washing | room temp. | 10 sec. |
| Drying | 40° C. | 9 sec. |

In the above, "w/w" in the indication in "%" refers to "weight/weight", and "w/v" to "weight/volume".

Using the samples having been photographically processed, degrees of the attraction of dust to the surfaces of the samples that is caused by static charging were tested by the following method.

Dust attraction test:

In an environment of 23° C. and 20% RH, the surfaces of the samples having been processed were rubbed several times with a rubber roller, and ashes of cigarette were brought close to the surfaces to examine whether or not the ashes are attracted to the film. Evaluation was made according to the following.

A: No ashes are attracted at all even when brought close by 1 cm.

AB: Ashes are attracted when brought close by 1 cm to 4 cm.

B: Ashes are attracted when brought close by 4 cm to 10 cm.

C: Ashes are attracted even when kept apart by 10 cm or more.

There is no problem in practical use if evaluated in the rank of AB or higher.

Samples evaluated as A or AB are acceptable, and those evaluated as B or C are unacceptable.

Constitution of each sample and results of evaluation are shown in Table 1.

TABLE 1

| | Support | | Fine particles | | | Static marks with; | | |
|---|---|---|---|---|---|---|---|---|
| Sample No. | Type | Dielectric constant | Type | Amount (g/l) | volume fraction (volume %) | Metal | Rubber | Dust attraction test |
| 1 | PEN-1 | 2.48 | A-1 | 60 | 36 | A | A | Accept. |
| 2 | PEN-1 | 2.48 | A-2 | 50 | 30 | A | A | Accept. |
| 3 | PEN-1 | 2.48 | A-3 | 50 | 30 | A | A | Accept. |
| 4 | PEN-1 | 2.48 | A-4 | 60 | 36 | A | A | Accept. |
| 5 | PEN-2 | 2.48 | A-1 | 60 | 36 | A | A | Accept. |
| 6 | PE | 2.31 | A-1 | 60 | 36 | A | A | Accept. |
| 7 | PE | 2.31 | A-2 | 50 | 30 | A | A | Accept. |
| 8 | PE | 2.31 | A-3 | 50 | 30 | A | A | Accept. |
| 9 | PS | 2.42 | A-1 | 60 | 36 | A | A | Accept. |
| 10 | PS | 2.42 | A-2 | 50 | 30 | A | A | Accept. |
| 11 | PS | 2.42 | A-3 | 50 | 30 | A | A | Accept. |
| 12 | PEN1 | 2.48 | — | — | — | D | C | Unacc. |
| 13 | PET | 2.90 | — | — | — | C | C | Unacc. |
| 14 | PE | 2.31 | — | — | — | D | D | Unacc. |
| 15 | PS | 2.42 | — | — | — | D | C | Unacc. |

PEN: Polyethylene-2,6-naphthalate
PE: Polyethlene
PS: Polystyrene
PET: Polyethlylene terephthalate As is seen from Table 1, those in which the subbing layer contains the fine metal oxide particles and the support has a dielectric constant of 2.8 or less are very well kept from occurrence of static marks and have no bad influence on photographic performances.

Example 2

Corona discharging of 8 W/m$^2$.min was applied to support PEN-1 on its both sides. On one side thereof, subbing coating solution D-1 was coated in a dried coating thickness of 0.8 μm to form subbing layer D-1. Corona discharging of 8 W/m$^2$.min was further applied thereon and subbing coating solution D-2 was coated in a dried coating thickness of 0.1 μm.

Subbing coating solution D-1.

| | |
|---|---|
| Copolymer latex solution comprised of 30% by weight of butyl acrylate, 20% by weight of t-butyl acrylate, 25% by weight of styrene and 25% by weight of 2-hydroxyethyl acrylate (solid content: 30%) | 270 g |
| Compound UL-1 | 0.6 g |
| Hexamethylene-1,6-bis(ethyleneurea) | 0.8 g |
| Made up to 1,000 ml by adding water. | |

Subbing coating solution D-2

| | |
|---|---|
| Gelatin | 10 g |
| Compound UL-1 | 0.2 g |

-continued

| | |
|---|---|
| Compound UL-2 | 0.2 g |
| Compound UL-3 | 0.1 g |
| Silica particles (average particle diameter: 3 μm) | 0.1 g |
| Made up to 1,000 ml by adding water. | |

On the opposite side of the support, antistatic layer coating solution D-3 shown below was coated in a dried coating thickness of 0.8 μm. In this layer, the volume fraction of the electric conductive fine particles was 35 volume %.

Antistatic layer coating solution D-3

| | |
|---|---|
| Copolymer latex solution comprised of 40% by weight of butyl acrylate, 20% by weight of butylene and 40% by weight of grycidyl acrylate (solid content: 30%) | 270 g |
| Compound UL-1 | 0.6 g |
| Hexamethylene-1,6-bis(ethyleneurea) | 0.8 g |
| Tin oxide sol, available from Taki Chemical Co., ltd. | 200 g |
| Made up to 1,000 ml by adding water. | |

The mixture solution was adjusted to pH 7.0, and formed into a dispersion by means of a stirring machine and a sand mill.

On the surface of the antistatic layer, magnetic recording layer coating solution D-4 shown below was further coated in a dried coating thickness of 1.0 μm. Thus, support sample No. 21 was produced. Support sample No. 22 was also produced in the same manner as sample No. 21 except that the above D-3 was replaced with D-5, a solution corresponding to D-3 from which the tin oxide sol had been removed.

Magnetic recording layer coating solution D-4.

In 150 parts by weight of toluene, 10 parts by weight of carnauba wax was dissolved with heating, followed by cooling. In the resulting solution, 75 parts by weight of cyclohexanone and 150 parts by weight of methyl ethyl ketone were mixed, and thereafter 100 parts by weight of nitrocellulose BTH-1/2 with solid content of 70% by weight, available from Asahi Chemical Industry Co., Ltd., and 5 parts by weight of Co-adhered $\gamma$-$Fe_2O_3$ (major axis: 0.8 μm; $Fe^{2+}/Fe^{3+}$: 0.2; Hc: 600 oersteds) were added thereto. The resulting mixture was intimately mixed by means of a dissolver, and thereafter dispersed using a sand mill to obtain a dispersion.

Formation of emulsion layers:

On the above subbing layer D-2, corona discharging of 25 $W/m^2$.min was further applied, and photographic component layers shown below were successively formed thereon to produce multi-layer light-sensitive color photographic materials.

In the following, the coating weights in the photographic component layers shown below are each indicated as a weight expressed in $g/m^2$ in terms of metallic silver in respect of silver halides and colloidal silver, a weight expressed in $g/m^2$ in respect of couplers and additives, and, in respect of sensitizers, a weight represented by molar number per mol of silver halide contained in the same layer.

| | |
|---|---|
| First layer: Anti-halation layer | |
| Black colloidal silver | 0.16 |
| Ultraviolet absorbent UV-1 | 0.20 |
| High-boiling solvent OIL-1 | 0.16 |
| Gelatin | 1.60 |
| Second layer: Intermediate layer | |
| Compound SC-1 | 0.14 |
| High-boiling solvent OIL-2 | 0.17 |
| Gelatin | 0.80 |
| Third layer: | |
| Low-speed red-sensitive layer | |
| Silver iodobromide emulsion A | 0.15 |
| Silver iodobromide emulsion B | 0.35 |
| Spectral sensitizer SD-1 | $2.0 \times 10^{-4}$ |
| Spectral sensitizer SD-2 | $1.4 \times 10^{-4}$ |
| Spectral sensitizer SD-3 | $1.4 \times 10^{-5}$ |
| Spectral sensitizer SD-4 | $0.7 \times 10^{-4}$ |
| Cyan coupler C-1 | 0.53 |
| Colored cyan coupler CC-1 | 0.04 |
| DIR compound Di-1 | 0.025 |
| High-boiling solvent OIL-3 | 0.48 |
| Gelatin | 1.09 |
| Fourth layer: | |
| Medium-speed red-sensitive layer | |
| Silver iodobromide emulsion B | 0.30 |
| Silver iodobromide emulsion C | 0.34 |
| Spectral sensitizer SD-1 | $1.7 \times 10^{-4}$ |
| Spectral sensitizer SD-2 | $0.86 \times 10^{-4}$ |
| Spectral sensitizer SD-3 | $1.15 \times 10^{-5}$ |
| Spectral sensitizer SD-4 | $0.86 \times 10^{-4}$ |
| Cyan coupler C-1 | 0.33 |
| Colored cyan coupler CC-1 | 0.013 |
| DIR compound Di-1 | 0.02 |
| High-boiling solvent OIL-1 | 0.16 |
| Gelatin | 0.79 |
| Fifth layer: High-speed red-sensitive layer | |
| Silver iodobromide emulsion D | 0.95 |
| Spectral sensitizer SD-1 | $1.0 \times 10^{-4}$ |
| Spectral sensitizer SD-2 | $1.0 \times 10^{-4}$ |
| Spectral sensitizer SD-3 | $1.2 \times 10^{-5}$ |
| Cyan coupler C-2 | 0.14 |
| Colored cyan coupler CC-1 | 0.016 |
| High-boiling solvent OIL-1 | 0.16 |
| Gelatin | 0.79 |
| Sixth layer: Intermediate layer | |
| Compound SC-1 | 0.09 |
| High-boiling solvent OIL-2 | 0.11 |
| Gelatin | 0.80 |

-continued

| | |
|---|---|
| Seventh layer: | |
| Low-speed green-sensitive layer | |
| Silver iodobromide emulsion A | 0.12 |
| Siiver iodobromide emulsion B | 0.38 |
| Spectral sensitizer SD-4 | $4.6 \times 10^{-5}$ |
| Spectral sensitizer SD-5 | $4.1 \times 10^{-4}$ |
| Magenta coupler M-1 | 0.14 |
| Magenta coupler M-2 | 0.14 |
| Colored magenta coupler CM-1 | 0.06 |
| High-boiling solvent OIL-4 | 0.34 |
| Gelatin | 0.70 |
| Eighth layer: Intermediate layer | |
| Gelatin | 0.41 |
| Ninth layer: | |
| Medium-speed green-sensitive layer | |
| Silver iodobromide emulsion B | 0.30 |
| Silver iodobromide emulsion C | 0.34 |
| Spectral sensitizer SD-6 | $1.2 \times 10^{-4}$ |
| Spectral sensitizer SD-7 | $1.2 \times 10^{-4}$ |
| Spectral sensitizer SD-8 | $1.2 \times 10^{-4}$ |
| Magenta coupler M-1 | 0.04 |
| Magenta coupler M-2 | 0.04 |
| Colored magenta coupler CM-1 | 0.017 |
| DIR compound Di-2 | 0.025 |
| DIR compound Di-3 | 0.002 |
| High-boiling solvent OIL-4 | 0.12 |
| Gelatin | 0.50 |
| Tenth layer: | |
| High-speed green-sensitive layer | |
| Silver iodobromide emulsion D | 0.95 |
| Spectral sensitizer SD-6 | $7.1 \times 10^{-5}$ |
| Spectral sensitizer SD-7 | $7.1 \times 10^{-5}$ |
| Spectral sensitizer SD-8 | $7.1 \times 10^{-5}$ |
| Magenta coupler M-1 | 0.009 |
| Colored magenta coupler CM-1 | 0.011 |
| High-boiling solvent OIL-4 | 0.11 |
| Gelatin | 0.79 |
| Eleventh layer: Yellow filter layer | |
| Yellow colloidal silver | 0.08 |
| Compound SC-1 | 0.15 |
| High-boiling solvent OIL-2 | 0.19 |
| Gelatin | 1.10 |
| Twelfth layer: | |
| Low-speed blue-sensitive layer | |
| Silver iodobromide emulsion A | 0.12 |
| Silver iodobromide emulsion B | 0.24 |
| Silver iodobromide emulsion C | 0.12 |
| Spectral sensitizer SD-9 | $6.3 \times 10^{-5}$ |
| Spectral sensitizer SD-10 | $1.0 \times 10^{-5}$ |
| Yellow coupler Y-1 | 0.50 |
| Yellow coupler Y-2 | 0.50 |
| DIR compound Di-4 | 0.04 |
| DIR compound Di-5 | 0.02 |
| High-boiling solvent OIL-2 | 0.42 |
| Gelatin | 1.40 |
| Thirteenth layer: | |
| High-speed blue-sensitive layer | |
| Silver iodobromide emulsion C | 0.15 |
| Silver iodobromide emulsion E | 0.80 |
| Spectral sensitizer SD-9 | $8.0 \times 10^{-5}$ |
| Spectral sensitizer SD-11 | $3.1 \times 10^{-5}$ |
| Yellow coupler Y-1 | 0.12 |
| High-boiling solvent OIL-2 | 0.05 |
| Gelatin | 0.79 |
| Fourteenth layer: First protective layer | |
| Silver iodobromide emulsion (average grain size: 0.08 μm; silver iodide content: 1.0 mol %) | 0.40 |
| Ultraviolet absorbent UV-1 | 0.065 |
| High-boiling solvent OIL-1 | 0.07 |

-continued

| | |
|---|---|
| High-boiling solvent OIL-3 | 0.07 |
| Gelatin | 0.65 |
| Fifteenth layer: Second protective layer | |
| Alkali-soluble matting agent (average particle diameter: 2 μm) | 0.15 |
| Polymethyl methacrylate (average particle diameter: 3 μm) | 0.04 |
| Lubricant WAX-1 | 0.04 |
| Gelatin | 0.55 |

In addition to the foregoing composition, coating aid Su-1, dispersion aid Su-2, viscosity modifiers, hardening agents H-1 and H-2, stabilizer ST-1, antifoggants AF-1 and two kinds of AF-2 with an average molecular weight of 10,000 and an average molecular weight of 1,100,000, and antiseptic DI-1 were added.

The emulsions used in the above sample are as follows. In the following, the average grain size is indicated as grain diameter calculated in that of a cube. The respective emulsions have been subjected to gold-sulfur sensitization to an optimum.

| Emulsion | Average AgI content (mol %) | Average grain size (μm) | Crystal habit | Diameter/ thickness ratio |
|---|---|---|---|---|
| A | 4.0 | 0.30 | Regular | 1 |
| B | 6.0 | 0.42 | Regular | 1 |
| C | 6.0 | 0.55 | Regular | 1 |
| D | 6.0 | 0.85 | Twinned tabular | 4 |
| E | 6.0 | 0.95 | Twinned tabular | 4 |

In preparing the samples, the first to eighth layers were provided by simultaneous coating at the first and the ninth to fifteenth layers were provided thereon by simultaneous coating at the second, using a multi-slide hopper type coater. Specific photographic sensitivity was ISO420. Structures of the compounds used in the preparation of the above samples are shown below.

UL-1

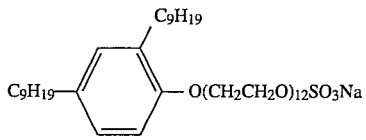

UL-2

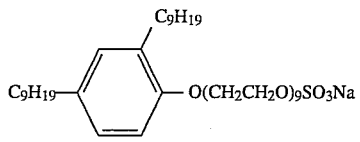

UL-3

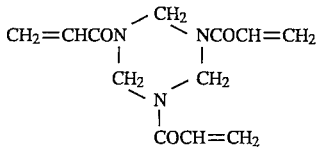

C-1

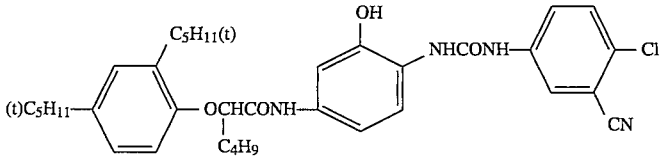

C-2

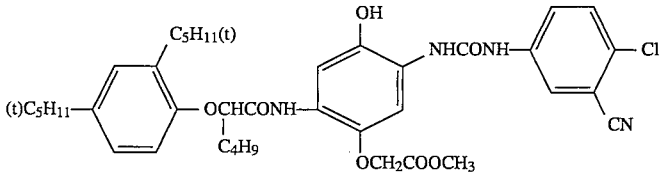

M-1

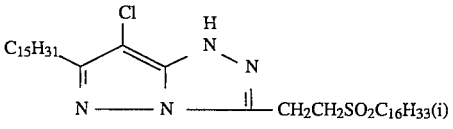

M-2

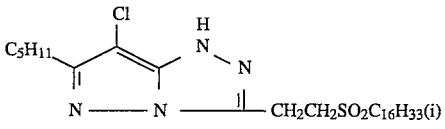

-continued
Y-1
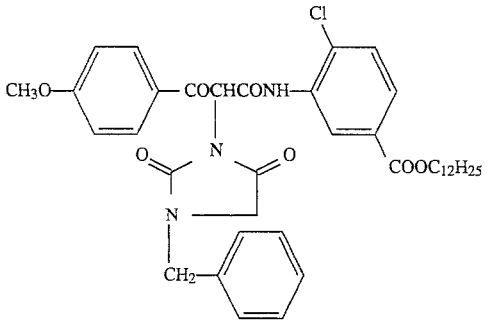
Y-2
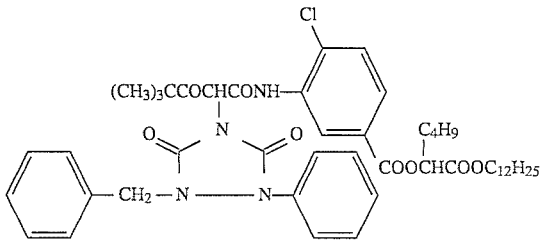
CC-1
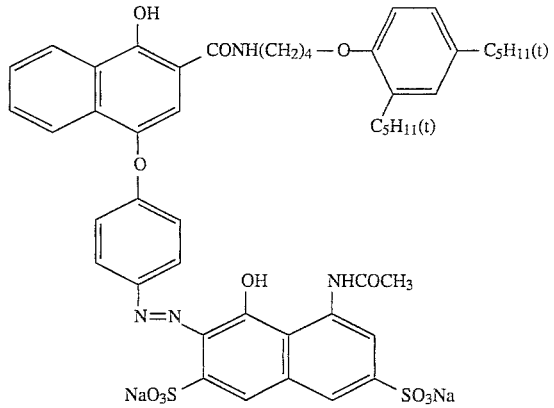
CM-1
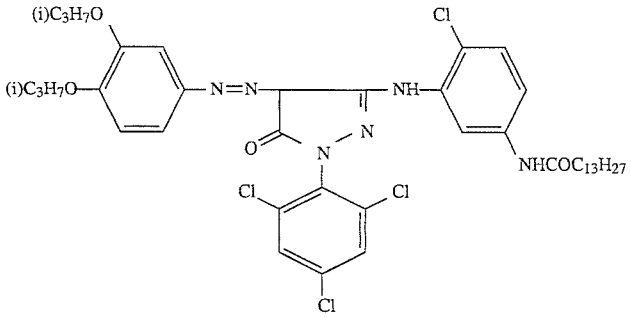
Di-1
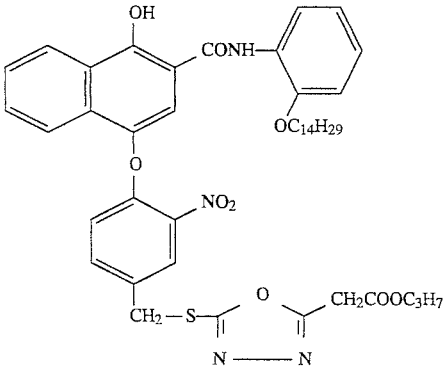
Di-2
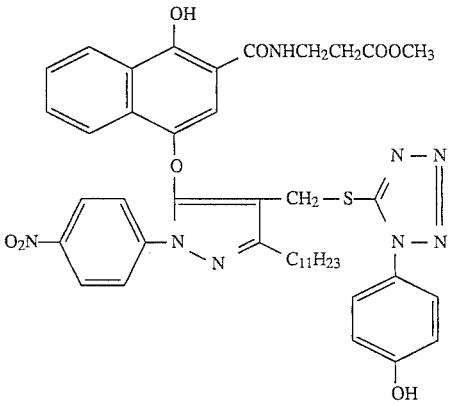

-continued
Di-3
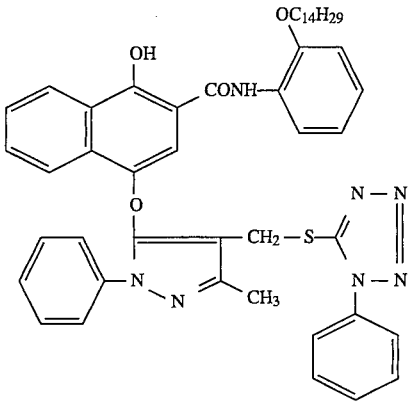
Di-4
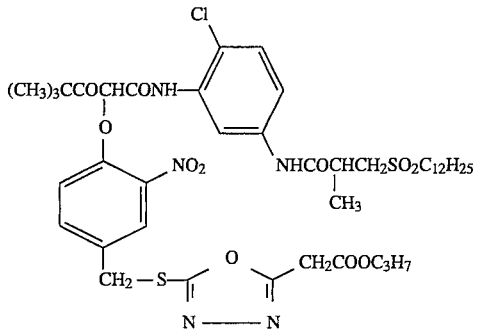
Di-5
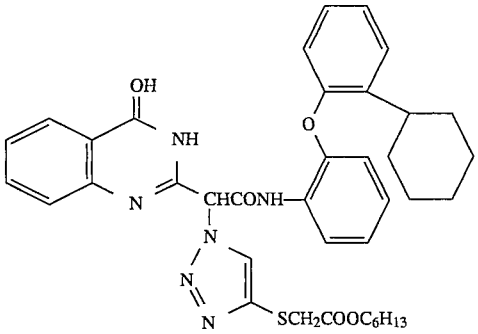
OIL-1
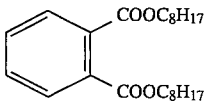
OIL-2
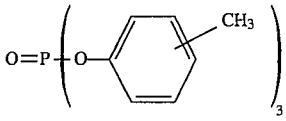
OIL-3
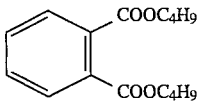
OIL-4
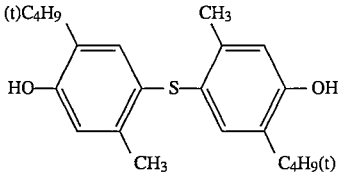
SC-1
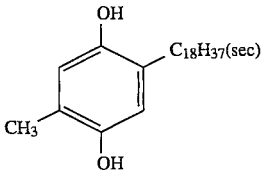
UV-1
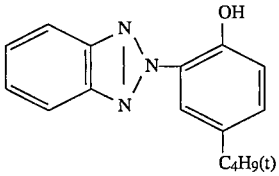
WAX-1
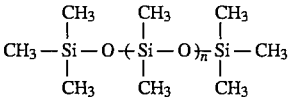
Mw = 3,000 (weight-average molecular weight)
Su-1
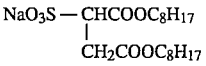
Su-2
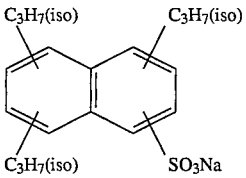
SD-1
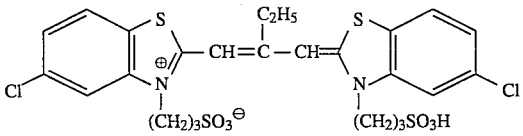
SD-2
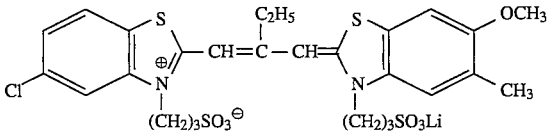

-continued
SD-3
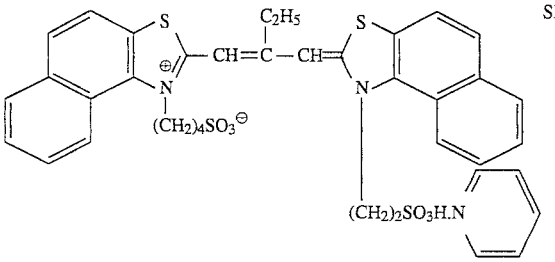
SD-4
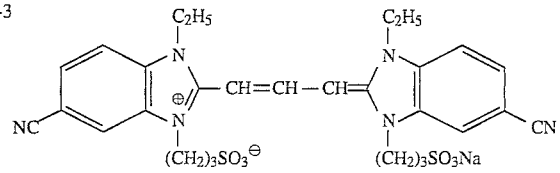
SD-5
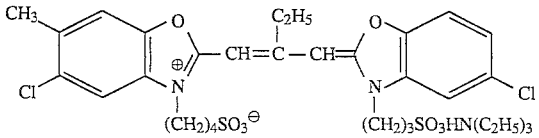
SD-6
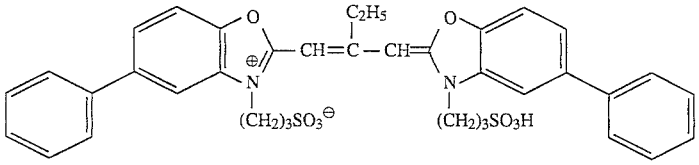
SD-7
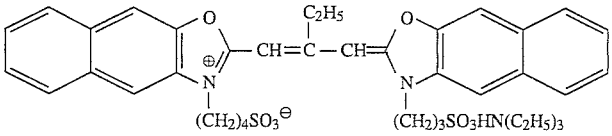
SD-8
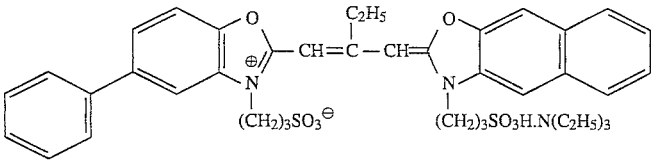
SD-9
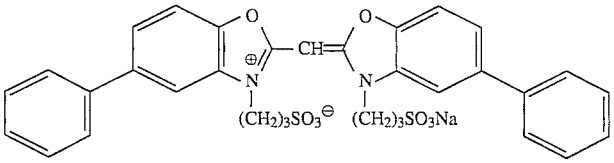
SD-10
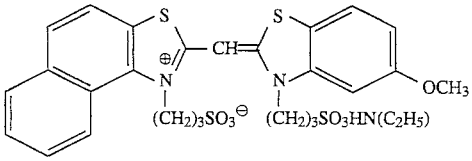
SD-11
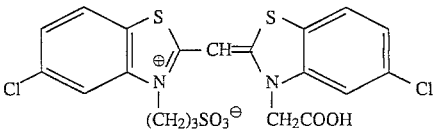
H-1
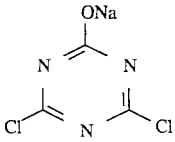
$(CH_{2CHSO_2}CH_2)_2O$ H-2
ST-1
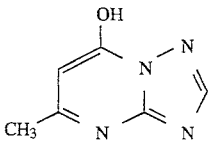
AF-1
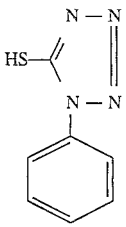

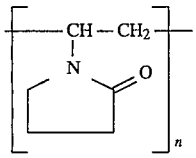

n: degree of polymerization

-continued

AF-2 (a mixture of the following three components) Compound DI-1

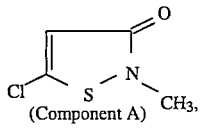

(Component A)

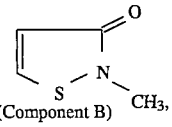

(Component B)

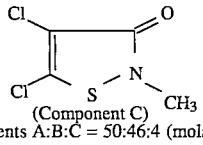

(Component C)

Components A:B:C = 50:46:4 (molar ratio)

Evaluation on samples:

On light-sensitive photographic material samples Nos. 21 and 22 thus produced, occurrences of static marks were evaluated in the same manner as in Example 1. The samples were photographically processed in the following way.

Photographic processing:

1. Color developing for 3 minutes 15 seconds at 38.0°±0.1° C.
2. Bleaching for 6 minutes 30 seconds at 38.0°±3.0° C.
3. Washing for 3 minutes 15 seconds at 24° C. to 41° C.
4. Fixing for 6 minutes 30 seconds at 38.0°±3.0° C.
5. Washing for 3 minutes 15 seconds at 24° C. to 41° C.
6. Stabilizing for 3 minutes 15 seconds at 38.0°±3.0° C.
7. Drying at 50° C. or below Processing solutions used in the respective steps were composed as shown below.

| Color developer | |
|---|---|
| 4-Amino-3-methyl-N-ethyl-N-(β-hydroxyethyl)aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Sodium nitrilotriacetate (monohydrate) | 2.5 g |
| Potassium hydroxide | 1.0 g |
| Made up to 1 liter by adding water (pH: 10.1). | |
| **Bleaching solution** | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Made up to 1 liter by adding water, and adjusted to pH 6.0 using ammonia water. | |
| **Fixer** | |
| Ammonium thiosulfate | 175.0 g |
| Anhydrous sodium sulfite | 8.5 g |
| Sodium metabisulfite | 2.3 g |
| Made up to 1 liter by adding water, and adjusted to pH 6.0 using acetic acid. | |
| **Stabilizer** | |
| Formalin (aqueous 37% solution) | 1.5 ml |
| KONIDAKS (trade name; available from Konica Corporation) | 7.5 ml |

-continued

| | |
|---|---|
| Made up to 1 liter by adding water. | |

Results of evaluation are shown in Table 2.

TABLE 2

| Sample No. | Support Type | Support Dielectric constant | Volume fraction of fine particles (volume %) | Static marks with; Metal | Static marks with; Rubber |
|---|---|---|---|---|---|
| 21 | PEN-1 | 2.48 | 36 | A | A |
| 22 | PEN-1 | 2.48 | 30 | D | C |

Static marks were seen to have not occurred in the systems in which the fine tin oxide particles according to the present invention were used.

What is claimed is:

1. A silver halide photographic light-sensitive material comprising a support having a dielectric constant of not larger than 2.80 at a frequency of 100 Hz, and having thereon:

a silver halide emulsion layer; and a particle-containing layer comprising non-light-sensitive fine particles having a volume resistivity of from $10^{-2}$ Ω.cm to $10^{8}$ Ω.cm.

2. The material of claim 1, wherein .said fine particles have a volume resistivity of from $10^{0}$ Ω.cm to $10^{8}$ Ω.cm.

3. The material of claim 1, wherein said support has a dielectric constant of from 2.20 to 2.60 at a frequency of 100 Hz.

4. The light-sensitive material of claim 1, wherein said particle-containing layer comprises said fine particles and a binder.

5. The light-sensitive material of claim 4, wherein said particles are contained said particle-containing layer with a volume fraction of 5% to 50%.

6. The light-sensitive material of claim 1, said particles each composed of crystallites having a size of from 5 Å to 300 Å.

7. The light-sensitive material of claim 1, wherein said particles has an average size of not larger than 10 μm.

8. The light-sensitive material of claim 1, wherein said particles are particles of ZnO, $TiO_2$ or $SnO_2$.

9. The light-sensitive material of claim 8, wherein said particles are particles of $SnO_2$.

10. The light-sensitive material of claim 1, wherein said particle-containing layer is a subbing layer, a layer provided between said emulsion layer and a subbing layer, a layer provided between said emulsion layer and another emulsion layer, a protective layer or a backing layer.

* * * * *